United States Patent [19]

Caruso

[11] Patent Number: 4,627,452

[45] Date of Patent: Dec. 9, 1986

[54] ELECTRICALLY HEATED HAIR ROLLER

[76] Inventor: Richard Caruso, 7801 Montgomery Ave., Elkins Park, Pa. 19117

[21] Appl. No.: 502,890

[22] Filed: Jun. 9, 1983

[51] Int. Cl.[4] ..... A45D 2/12

[52] U.S. Cl. ..... 132/33 R; 132/39; 132/42 A

[58] Field of Search ..... 132/33 R, 40, 42, 39, 132/41, 117, 36 A, 36, 31, 33 G

[56] References Cited

U.S. PATENT DOCUMENTS

| | | | |
|---|---|---|---|
| Re. 26,766 | 1/1970 | Jorgensen | 132/33 R |
| 1,442,260 | 1/1923 | Fister | 132/40 UX |
| 2,380,154 | 7/1945 | Dickerson | 132/33 R |
| 3,241,560 | 3/1966 | Willat | 132/33 R UX |
| 3,260,267 | 7/1966 | Rubenstein et al. | 132/40 |
| 3,455,309 | 7/1969 | Koss | 132/33 R |
| 3,523,542 | 8/1970 | Elsier | 132/40 |
| 3,586,820 | 6/1971 | Yamanaka | 132/33 R |
| 3,696,819 | 10/1972 | Jensen | 132/33 R |
| 3,759,271 | 9/1973 | Caruso | 132/33 G |
| 4,202,360 | 5/1980 | Henry | 132/40 |
| 4,224,955 | 9/1980 | Meyorhoefer | 132/33 R |
| 4,453,554 | 6/1984 | Caruso | 132/33 R |

OTHER PUBLICATIONS

Clairol roller and advertisement of same with copyright notices of 1981 and 1983.

*Primary Examiner*—Gregory E. McNeill

*Attorney, Agent, or Firm*—Seidel, Gonda, Goldhammer & Abbott

[57] ABSTRACT

A hair roller having a core open at one end is adapted to receive an electrical heater. The core is electrically conductive and is surrounded by a non-metallic sleeve. Non-metallic end caps are connected to each end of the core. A generally C-shield frictionally embraces the end caps.

11 Claims, 12 Drawing Figures

FIG. 5
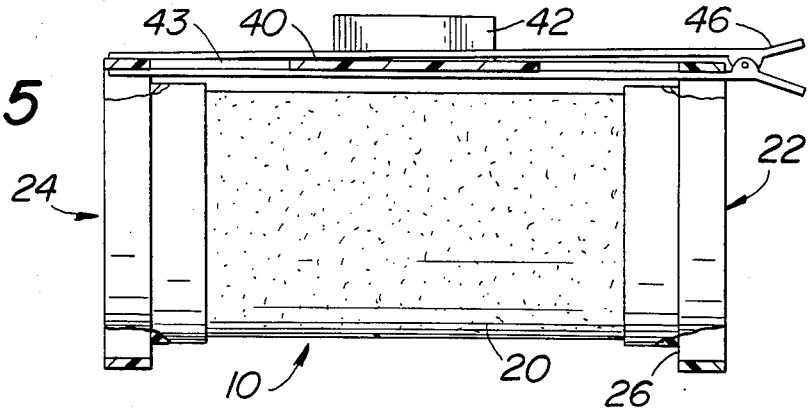
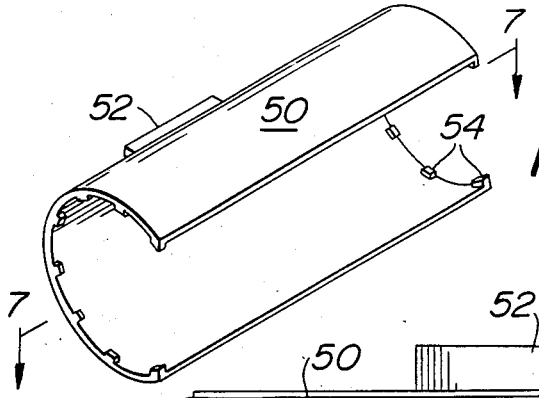
FIG. 6
FIG. 7
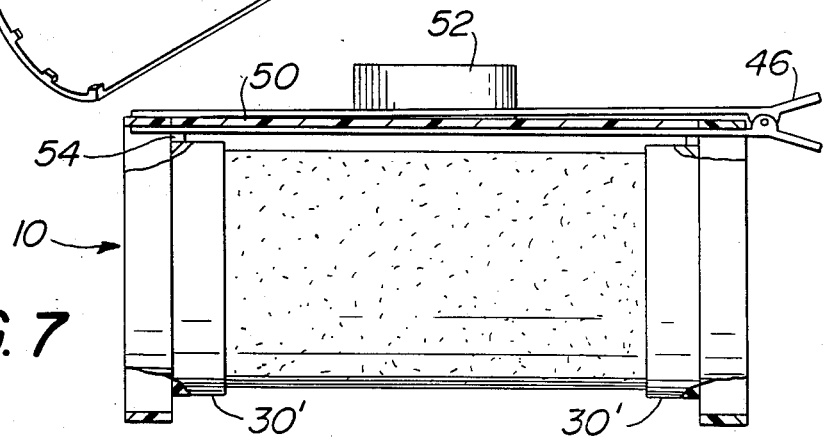
FIG. 9
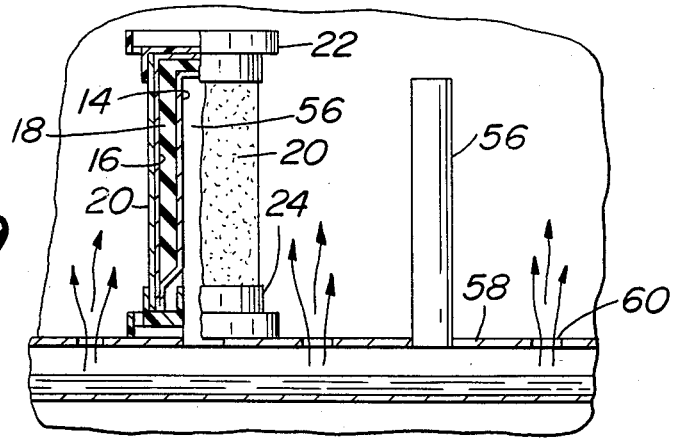

FIG. 8
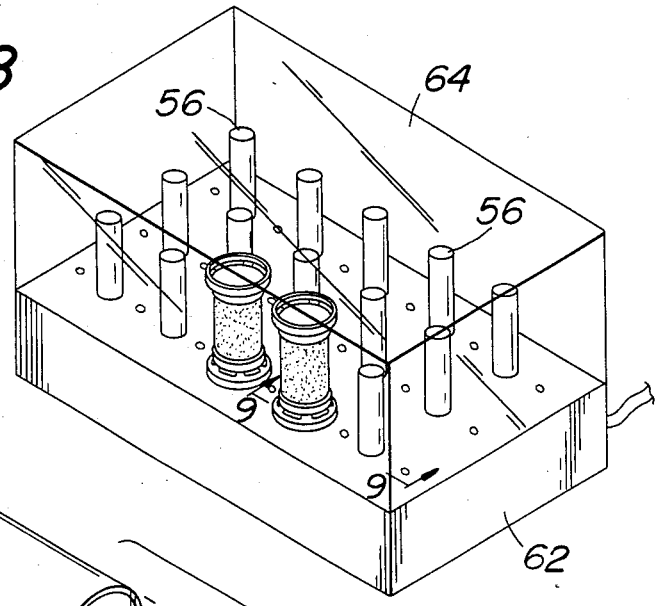
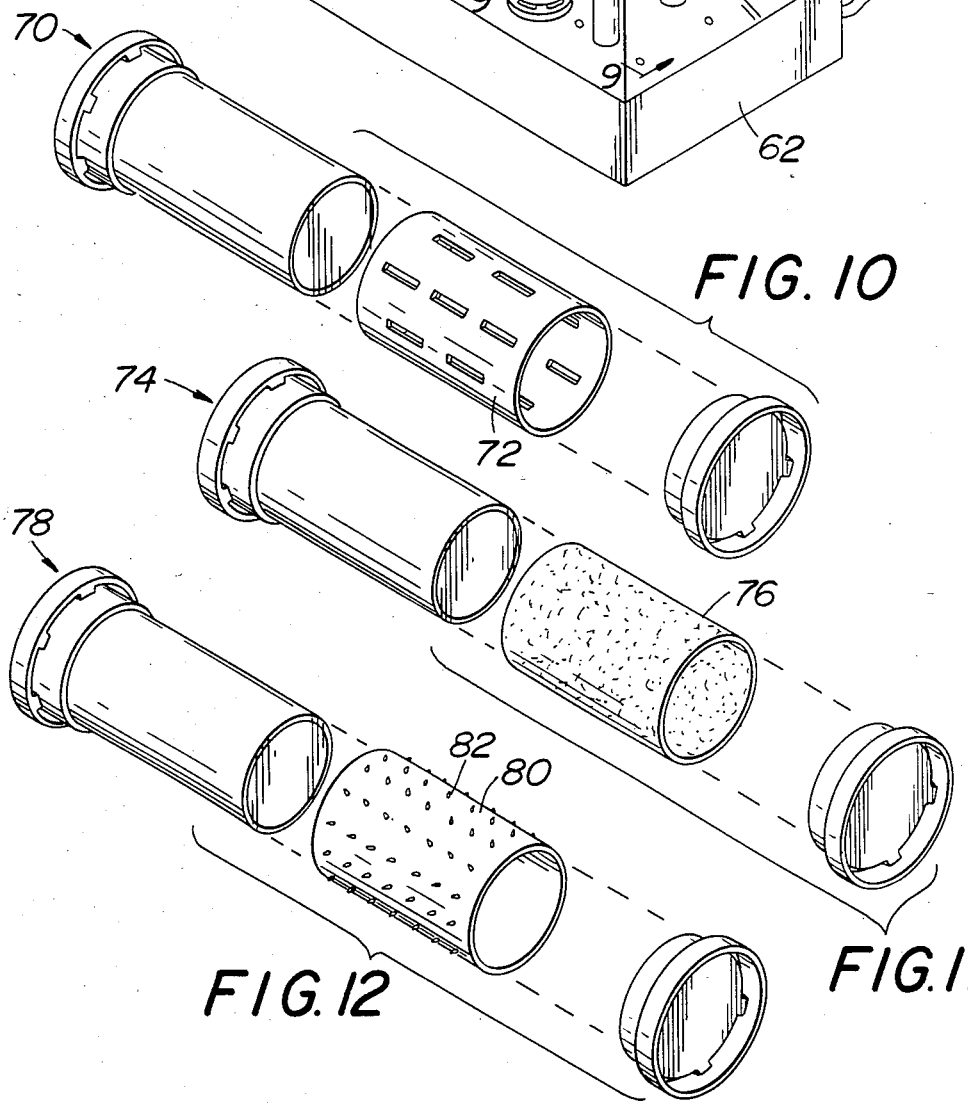
FIG. 10
FIG. 11
FIG. 12

ELECTRICALLY HEATED HAIR ROLLER

BACKGROUND OF THE INVENTION

Hair rollers which are adapted to be steam heated have a perforated core. See the device disclosed in U.S. Pat No. 3,759,271 which discloses a typical steam roller having a shield associated therewith.

Electrically heated hair rollers are per se known. I have found that the provision of a shield with an electrically heated roller substantially increases the effectiveness of the hair roller by materially increasing the amount of steam which is available at the sleeves surrounding the core since the sleeve is subjected to internal heat and a substantially greater amount of steam will remain in contact with the sleeve.

SUMMARY OF THE INVENTION

The present invention is directed to a hair roller having a core which is open at one end and adapted to receive an electrical heater. The core is electrically conductive and surrounded by a non-metallic sleeve. A non-metallic end cap is connected to each end of the core. A generally C-shaped shield is provided with open ends. The shield frictionally embraces the end caps and is spaced from the sleeve whereby steam may enter the chamber between the shield and sleeve while the core is being heated.

It is an object of the present invention to improve the effectiveness of electrically heated hair rollers by providing such rollers with a shield.

Other objects and advantages will appear hereinafter.

For the purpose of illustrating the invention, there is shown in the drawings, a form which is presently preferred; it being understood, however, that this invention is not limited to the precise arrangements and instrumentalities shown.

FIG. 5 is an assembled view, partly in section showing the shield in FIG. 4 embracing a roller.

FIG. 6 is a perspective view of another shield in accordance with the present invention.

FIG. 7 is a view similar to FIG. 5 by showing the shield of FIG. 6.

FIG. 8 is a perspective view of a steamer.

FIG. 9 is a sectional view taken along the line 9—9 in FIG. 8 but on an enlarged scale.

FIG. 10 is an exploded view of another roller.

FIG. 11 is an exploded view of another roller.

FIG. 12 is an exploded view of another roller.

DETAILED DESCRIPTION

Figure 1:
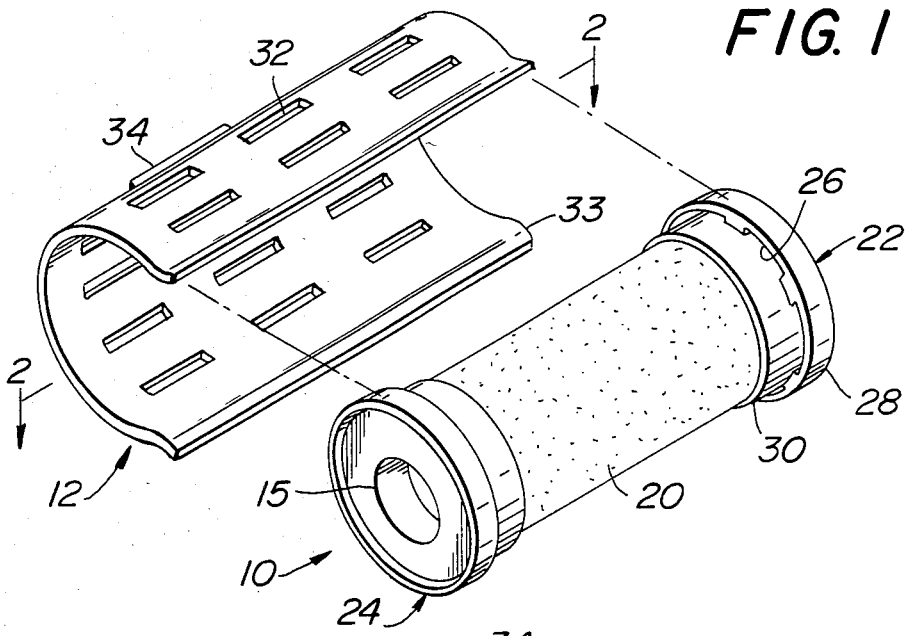
FIG. 1 is an exploded view of a hair roller and shield in accordance with the present invention.
Figure 2:
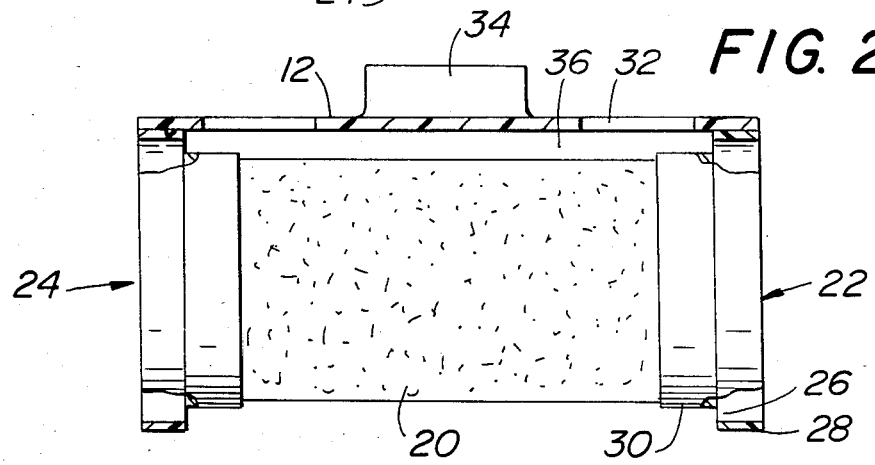
FIG. 2 is a sectional view taken along the line 2—2 in FIG. 1 in connection with the assembled roller and shield.

Referring to the drawings in detail, wherein like numerals indicate like elements, there is shown in FIG. 1 an electrically heated hair roller 10 in association with a shield designated generally as 12.

Figure 3:
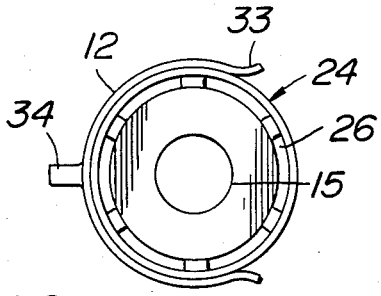
FIG. 3 is an end view of the shield and roller as shown in FIG. 2.

The roller 10 is adapted to be heated and steamed in a housing as shown in FIG. 8. As shown more clearly in FIG. 9, the roller 10 includes a core having an inner wall 14 radially spaced from an outer wall 16. A heat transfer medium such as wax 18 is provided between the walls 14 and 16. Walls 14 and 16 are made from an electrically conductive material having good heat transfer characteristics such as aluminum. The chamber within wall 14 is provided with an inlet opening 15 at one end, see FIGS. 1 and 3.

A sleeve 20 of non-metallic material surrounds the wall 16 and is in good heat transfer contact therewith. Sleeve 20 is preferably adhesively bonded to the outer periphery of wall 16 and has a length corresponding to the length of wall 16. The sleeve 20 is preferably a fibrous material held together with a binder and may be porous to steam.

An end cap 22 is force-fit over one end of the sleeve 20. The end cap 24 is force-fit over the other end of sleeve 20. The end caps are preferably made from a non-metallic material such as a polymeric plastic. Each end cap has a rim 28 connected to a hub 30 of smaller diameter with a plurality of flow passages such as slots 26 therebetween. End cap 24 has an inlet opening 15 communicating with the open end of the chamber within wall 14.

The shield 12 is generally C-shaped with lips 33 extending in opposite directions at free edges of the shield. The shield is open at both ends. The shield 12 preferably has a handle 34 to facilitate handling of the same. Shield 12 also includes a plurality of flow passages such as slots 32 to facilitate transmission of steam into the chamber 36. Chamber 36 is defined by the outer periphery of sleeve 20 and hubs 30 and the inner periphery of shield 12.

Figure 4:
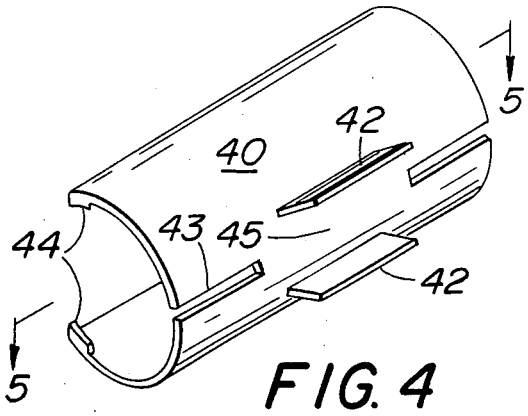
FIG. 4 is a perspective view of another shield in accordance with the present invention.

In FIG. 4 there is shown a perspective view of an alternative shield designated 40. Shield 40 has a pair of tabs which facilitate handles 42. Slots 43 are provided as shown so that each handle is on opposite ends of a hinge 45 at the bight whereby the free edges may move away from each other for ease of embracing a roller 10. At its ends, and adjacent the free edges, shield 40 has projections 44.

In FIG. 5, shield 40 is shown embracing the roller 10. The projections 44 contact the outer periphery of the rims 28 and thereby result in a flow passage in an axial direction between the shield 40 and the rims 28 for entry of steam into the chamber between the inner periphery of shield 40 and the outer periphery of the sleeve 20. If desired, the shield 40 and roller 10 may be held in an assembled relationship by a clip 46 having one leg extending through aligned slots 26.

In FIG. 6, there is illustrated another shield designated 50. The shield 50 is identical with shield 40 except that there are provided a plurality of spaced projections 54 on the inner peripheral surface of each end of the shield. Projections 54 perform the same function as projections 44. In FIG. 7, shield 50 is shown clipped to a roller 10. Sleeve 50 has a length which is slightly less than the distance between the rims so that projections 54 contact the hubs 30' adjacent the rims.

In FIG. 8, there is illustrated a housing 62 having a transparent cover 64. Within the housing there is provided a plurality of electrical heater posts 56. As shown more clearly in FIG. 9, a roller 10 is telescoped over one of the posts 56 to facilitate heating the core. Post 56 is supported by a wall 58 having holes 60. Steam exits from the holes 60 and heats the sleeve 20. Any one of shields 12, 40 and 50 may be utilized to envelop a substantial portion of the roller 10 while permitting steam to enter into the space therebetween. Hence, roller 10 will be electrically heated internally and will have its sleeve 20 heated by steam. The shields help in retaining the steam in chamber 36 after removal of the roller by grasping on the handle of the shield.

In FIG. 10 there is illustrated another embodiment of the roller designated generally as 70. Roller 70 is identical with roller 10 except that the sleeve 72 is perforated.

In FIG. 11 there is illustrated another embodiment of the roller designated generally 74. Roller 74 is the same as roller 10 except that the sleeve 76 is a porous foam plastic.

In FIG. 12 there is illustrated another roller which is identical with roller 10 except that the sleeve 80 is a plastic sleeve having teeth 82 projecting therefrom.

The advantages of having a shield in association with a steamed hot roller are as follows. The entire length of a hair strand is curled evenly. Hair is curled faster and gives a much stronger curl that lasts longer. The roller heats up quicker. The hair is conditioned by circulation of moisture in the form of steam. The shield can hold the hair around the roller to prevent the hair from unwinding without the necessity of a clip such as clip 46.

As will be apparent from the above, the shield may have different configurations. Likewise, the rollers may have different materials for the sleeve surrounding the core.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising a hair curler having a core arranged at one end for temporary contact with an external electrical heater, said core being an electrically conductive metal, a non-metallic end cap connected to each end of the core, a generally C-shaped shield open at both ends, said shield frictionally embracing a portion of said end caps, said shield having its inner surface spaced from said core by said end caps, means defining slots through which steam may enter the space between the shield and core while the core is being heated, and said shield being provided with a handle to facilitate manipulation thereof, said handle projecting generally radially outwardly of the sleeve at a location adjacent its bight.

2. Apparatus in accordance with claim 1 wherein said core is defined by spaced inner and outer walls, and a heat transfer medium in the space between said inner and outer walls of the core.

3. Apparatus in accordance with claim 2 including a sleeve bonded to the outer periphery of the core outer wall, and said end caps being telescoped over the ends of said sleeve.

4. Apparatus comprising a hair curler having a core arranged at one end for temporary contact with an external electrical heater so that the core may be electrically heated before it is used to curl hair, a discrete, preformed non-metallic sleeve surrounding said core and in heat transfer contact with the outer periphery of said core, and means on the hair curler defining at least one flow passage through which steam may contact said sleeve while said core is being electrically heated by an external heater.

5. Apparatus in accordance with claim 4 wherein said hair curler has end members, each end member being at one end of the hair curler and projecting radially outwardly beyond the outer periphery of said sleeve, said flow passage being in at least one of said end members.

6. Apparatus in accordance with claim 5 including a generally C-shaped shield open at both ends, said shield having its inner surface spaced from said sleeve to define a space of predetermined radial dimensions between the shield and sleeve for receiving hair to be curled and defining a chamber for receiving steam through said flow passage while said core is being electrically heated.

7. A hair curler for dry hair comprising:

a tubular heat conductive central core adapted to be heated prior to being applied to the hair, a heat conductive sleeve upon which hair may be rolled surrounding said core and in heat transfer relation to said core, an annular rim at each end of the core supported with its surface spaced radially outward from the outer surface of the sleeve, and a C-shaped shield adapted to be engaged with and supported by said rims in spaced relation to the radially outward surface of said sleeve while the curler is being heated prior to being applied to the hair and after said curler has been applied to the hair.

8. Apparatus in accordance with claim 7 including an open axial passage through at least one of said rims through which steam may pass while said curler is being heated prior to being applied to the hair.

9. A hair curler in accordance with claim 7 wherein said C-shaped shield is unitary in construction and made of a resilient material.

10. A hair curler in accordance with claim 7 wherein said rims and said sleeve are removable from said core for replacing said sleeve.

11. Apparatus in accordance with claim 9 wherein said shield is provided with a handle to facilitate manipulation thereof, and said handle projects generally radially outwardly from the shield at a location adjacent its bight.

* * * * *